US009206602B2

(12) United States Patent
Cave et al.

(10) Patent No.: US 9,206,602 B2
(45) Date of Patent: Dec. 8, 2015

(54) LOFT FLOORING SYSTEM

(76) Inventors: Piers St. John Spencer Galliard Cave, Woking (GB); Paul Andrew Godfrey, New Bridge House (GB); David John Lennan, London (GB)

( * ) Notice: Subject to any disclaimer, the term of this patent is extended or adjusted under 35 U.S.C. 154(b) by 0 days.

(21) Appl. No.: 13/575,394

(22) PCT Filed: Jan. 26, 2011

(86) PCT No.: PCT/GB2011/000096

§ 371 (c)(1),
(2), (4) Date: Dec. 14, 2012

(87) PCT Pub. No.: WO2011/092460

PCT Pub. Date: Aug. 4, 2011

(65) Prior Publication Data

US 2013/0133282 A1 May 30, 2013

(30) Foreign Application Priority Data

Jan. 26, 2010 (GB) ..... 1001224.3
Aug. 20, 2010 (GB) ..... 1013999.6

(51) Int. Cl.

| | |
|---|---|
| ***E04B 5/43*** | (2006.01) |
| ***E04F 15/024*** | (2006.01) |
| ***E04B 5/48*** | (2006.01) |
| ***E04B 5/12*** | (2006.01) |

(52) U.S. Cl.

CPC ... *E04B 5/43* (2013.01); *E04B 5/12* (2013.01); *E04B 5/48* (2013.01); *E04F 15/02452* (2013.01); *E04F 15/02458* (2013.01)

(58) Field of Classification Search

CPC ..... E04B 5/43; E04B 5/48; E04B 5/12; E04B 5/02; E04F 15/02452; E04F 15/02405; E04F 15/024; E04F 15/18; E04F 15/22

USPC ..... 52/506.03–506.07, 653.1, 118–121, 52/125.1, 126.1, 126.6, 654.1, 655.1, 848, 52/636, 638

See application file for complete search history.

(56) References Cited

U.S. PATENT DOCUMENTS

| | | | | | |
|---|---|---|---|---|---|
| 1,415,273 | A | * | 5/1922 | Stevens | 52/402 |
| 1,706,945 | A | * | 3/1929 | White | 52/376 |
| 2,151,399 | A | * | 3/1939 | White | 52/289 |
| 2,284,898 | A | * | 6/1942 | Hartman | 52/654.1 |
| 3,180,460 | A | * | 4/1965 | Liskey, Jr. | 52/479 |
| 3,477,189 | A | * | 11/1969 | Merson | 52/650.3 |
| 3,583,121 | A | * | 6/1971 | Tate et al. | 52/22 |
| 3,606,704 | A | * | 9/1971 | Denton | 52/167.8 |
| 3,882,653 | A | * | 5/1975 | Ollman | 52/694 |
| 3,994,111 | A | * | 11/1976 | Papayoti | 52/650.3 |
| 5,501,754 | A | * | 3/1996 | Hiraguri | 156/71 |

(Continued)

*Primary Examiner* — Jeanette E Chapman

(74) *Attorney, Agent, or Firm* — Invention to Patent Services; Alex Hobson

(57) ABSTRACT

The present invention provides a loft flooring system that comprises: a plurality of bridging supports each adapted to bridge between an adjacent substantially parallel pair of joists of a loft floor and having a first upright leg with a foot to mount onto a first of the joists and a second upright leg with a foot to mount onto a second of the joists, and a spanning element therebetween onto which flooring boards/panels may be laid. The insulation can be laid between the joists to a required depth rising above the joists and the bridging support mounted in place accommodating the laid insulation thereunder so that the insulation remains substantially un-compacted and fully effective.

19 Claims, 12 Drawing Sheets

(56) References Cited

U.S. PATENT DOCUMENTS

| | | | | |
|---|---|---|---|---|
| 6,079,178 | A * | 6/2000 | Fisher | 52/690 |
| 6,205,736 | B1 * | 3/2001 | Amborn et al. | 52/633 |
| 6,755,001 | B2 * | 6/2004 | Eaton | 52/506.06 |
| 6,799,406 | B2 * | 10/2004 | Gosselin et al. | 52/694 |
| 8,011,156 | B1 * | 9/2011 | Schwan | 52/653.1 |
| 8,769,899 | B2 * | 7/2014 | Barry et al. | 52/480 |
| 2009/0282766 | A1 * | 11/2009 | Roen | 52/506.08 |
| 2010/0011680 | A1 * | 1/2010 | Takahashi | 52/167.1 |

* cited by examiner

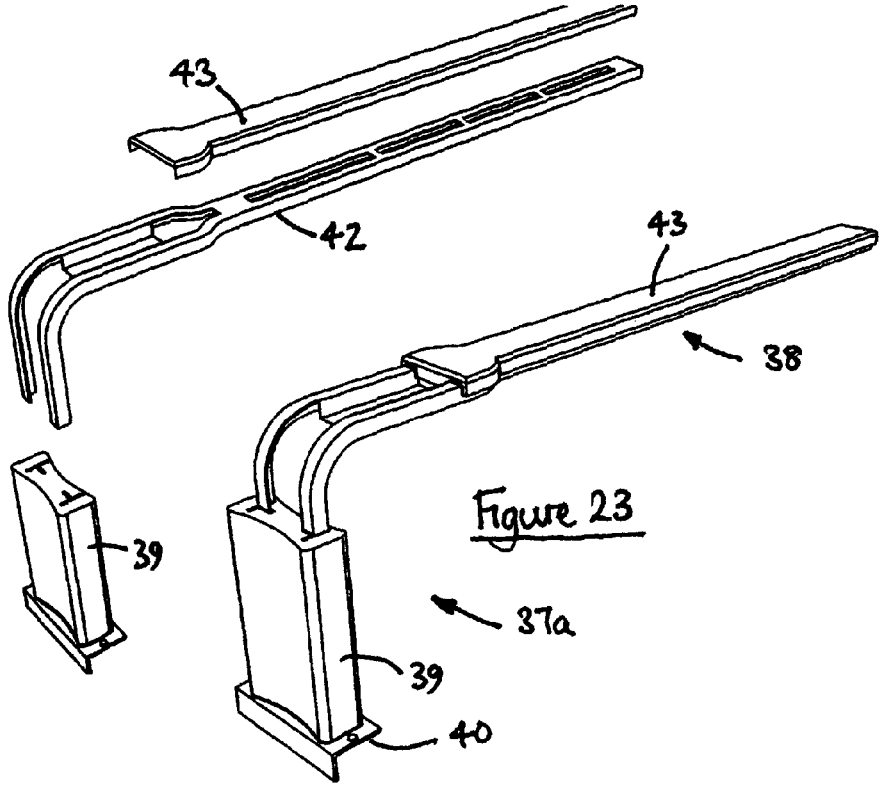
Figure 22
Figure 23
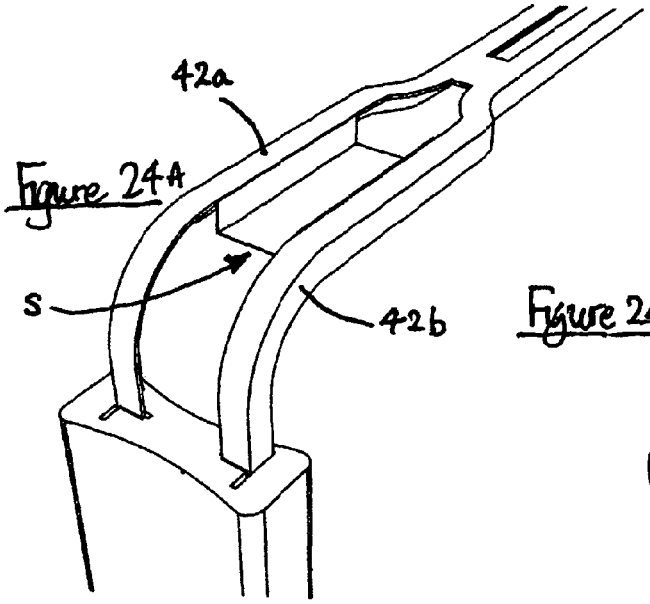
Figure 24A
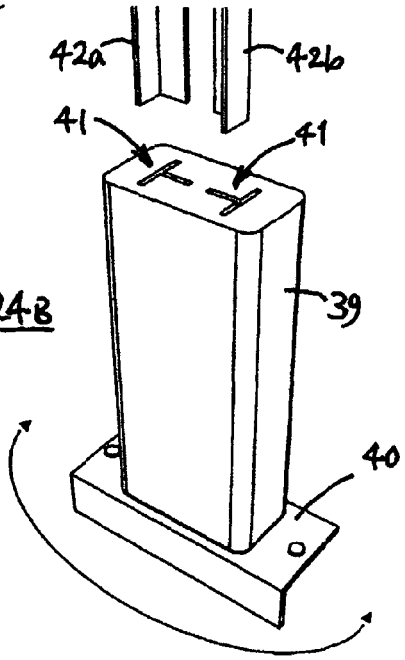
Figure 24B

LOFT FLOORING SYSTEM

CROSS REFERENCE TO RELATED APPLICATIONS

The present invention claims the benefit of PCT/GB2011/000096, entitled LOFT FLOORING SYSTEM filed on Jan. 26, 2011, which claims the benefit of GB1013999.6 filed on Aug. 20, 2010, and GB1001224.3 filed on Jan. 26, 2010, all of which are incorporated by reference herein.

FIELD OF THE INVENTION

The present invention concerns improvements in and relating to loft, flooring systems that are adapted to preserve the recommended depth of loft insulation material in the loft when laying the flooring.

BACKGROUND TO THE INVENTION

Energy efficiency of buildings is a pressing issue that now affects us all. There is increasingly widespread appreciation of the need for better building insulation to combat thermal energy wastage and its associated costs to the environment as well as the direct cost to the property owner or tenant. Alongside cavity wall insulation, loft insulation is the major target for improvement in many homes and a key feature or recommendation point in the now statutory energy efficiency survey that accompanies all residential property transactions in the UK.

UK government and building industry recommendations are for a 270-300 mm depth of insulation material to be laid in the loft/attic between the joists of the loft/attic floor to reduce loss of inexorably rising internal heat into the loft space and out through the roof. Indeed, Part L of the current UK Building Regulations requires a depth of at least 250 mm. Since most joists (also known as ceiling ties) are 84 mm or 100 mm deep, in general the insulation will need to rise 200 mm or more above the top of the joists and thus any flooring subsequently laid over the joists will generally compact the insulation back down by that difference in depth. Such compaction greatly reduces the effectiveness of the insulation, which relies on being un-compacted in order to trap air in pockets and thus should be avoided.

In the case of installing permanent loft flooring in the manner of a loft conversion, turning the loft into proper living space, the issue is normally avoided/addressed by transferring the insulation capability from the floor to the rafters of the roof instead. However, for the more temporary loft flooring that is often installed by home-owners themselves to serve as a platform for storage of belongings in the loft there will generally not be an obligation or desire to expensively line the roof in place of the loft floor.

The compaction of the loft floor insulation is generally ignored until flagged up in a subsequent energy efficiency survey carried out prior to sale of the property. However, this is of course, very energy wasteful and the problem has inspired some consideration in the industry. A primary proposal for addressing the problem is to lay an array of mutually parallel boards/battens edge-on on top of the joists running orthogonal to the joists and to be nailed down to the joists to provide a raised floor with the insulation filled firstly between the joists and then between the battens. This system is time-consuming to install and, if needed, also time-consuming to uninstall and the upper part of the insulation either needs to be laid separately or be locally crushed where the battens run.

A further proposal to address the compaction problem is outlined in GB 2438620A (Milner) and entails provision of box beam spacers that are again laid on top of the joists running orthogonal to the joists and to be nailed down with blocks to the joists. With this latter system the box beam spacers are specially constructed having a rectangular box form with opposing sidewalls and top and bottom walls and to achieve the required insulation depth using the system the insulation material must be inserted into the rectangular box form. This system lacks versatility and although it is somewhat less time-consuming to install than the other prior systems it is rendered awkward by the need to fill the insulation firstly between the joists and then into the spacers and between the spacers rather than simply laying it between the joists.

It is a general object of the present invention to provide a new system and method for laying a loft floor to address the problem of insulation compaction and which is comparatively straightforward and efficient to install and, where needed, uninstall.

SUMMARY OF THE INVENTION

According to a first aspect of the present invention there is provided a loft flooring system that comprises: a plurality of bridging supports each adapted to bridge between a substantially parallel pair of joists of a loft floor and having a first upright leg with a foot to mount onto a first of the joists and having, in use, a second upright leg with a foot to mount onto a second of the joists, and a spanning element therebetween defining a flooring surface or onto which flooring boards or panels may be laid. Using this system the insulation may first be laid between the joists to a depth rising above the joists and the bridging support then mounted in place accommodating the laid insulation thereunder without compaction of the insulation.

Preferably the foot of the first and/or second upright leg is formed with a bracket that fits to a top surface and a sidewall of the joist. In one embodiment one of the first and second legs has a foot in the form of such a bracket while the other of the first and second legs has a foot in the form of a plate. Preferably the bracket is provided with a channel profile to fit not only to a top surface and a sidewall of the joist but to the opposing sidewall too as a saddle. In each case the fit of the bracket to that joist limits or substantially prevents movement of the bridging support in either direction orthogonal to the joists. The part of each bracket that fits to a said top surface of a joist extends from the leg in each direction lengthwise of the joist and provides support against toppling in a direction lengthwise of the joist. The configuration of the bridging supports and their feet provide for a high level of stability and security in use.

The span of the bridging support is adapted to conform to the separation of the joists and to form a bridge over the joists with a void between the legs that is aligned with and contiguous with the void/channel between the joists—unlike the prior art which is configured to run orthogonal to the joists/inter-joist channel. This arrangement uniquely allows insulation to be laid between the joists to the required depth rising above the joists and the bridging support then mounted in place accommodating the laid insulation.

Preferably the legs comprise or incorporate walls whereby the bridging support defines a tunnel/channel that runs in the direction of the joists and is contiguous with the void between the joists in use so that insulation may be laid between the joists to the required depth rising above the joists and the bridging support then mounted in place and accommodating the laid insulation within the tunnel/channel.

Preferably the spanning element of each bridging support is augmented by an extension section that extends beyond the span between the legs and which is adapted to provide an overlap with a next adjacent bridging support on a next adjacent pair of joists to rest thereon. For optimal inter-fit this suitably is adapted to overlap a recess/rebate provided on the near side of the next adjacent bridging support so that the upper surfaces of the spanning element of each bridging support define a substantially continuous level support surface for the flooring.

Preferably each bridging support is adapted to be able to inter-fit with each next adjacent bridging support in the longitudinal direction of the joists suitably by having one or more protrusions at one end thereof to locate in one or more sockets in the adjacent face of the next adjacent bridging support in the longitudinal direction of the joists.

The system may suitably further comprise a plurality of panels of chipboard or fibre-board to overlie the bridging supports to define the loft flooring.

According to a second aspect of the present invention there is provided a method of laying loft flooring and insulation that comprises: providing a plurality of bridging supports each adapted to bridge between a substantially parallel pair of joists of a loft floor and having a first upright leg with a foot to mount onto a first of the joists and, in use, a second upright leg with a foot to mount onto a second of the joists, and a spanning element therebetween defining a flooring surface or onto which flooring boards or panels may be laid; and laying insulation to a required depth before or after mounting the bridging supports in place accommodating the laid insulation under the flooring surface or flooring boards or panels laid on the spanning element whereby the insulation remains substantially un-compacted. Preferably insulation is first laid between the joists to a depth that rises above the joists and the bridging supports are subsequently mounted in place thereover, bridging between the joists.

According to a further aspect of the present invention there is provided a loft flooring system that comprises: a plurality of bridging supports each adapted to bridge between a substantially parallel pair of joists of a loft floor and having a first upright leg with a foot to mount onto a first of the joists and having, in use, a second upright leg with a foot to mount onto a second of the joists, and a spanning element therebetween onto which flooring boards or panels can be laid, wherein the foot of the first and/or second upright leg is formed with a right-angled bracket that fits to a top surface and a sidewall of the joist or a formed with a channel profile bracket to fit not only to a top surface and a sidewall of a said joist but to the opposing sidewall too as a saddle whereby the fit of the bracket to that joist limits or substantially prevents movement of the bridging support in a direction orthogonal to the joists.

According to a yet further aspect of the present invention there is provided a loft flooring system that comprises: a plurality of bridging supports that are mounted in use to joists of a loft and each having an upright leg with a foot that mounts onto a joist and a connecting portion, the bridging supports being assembled in a row to provide a support assembly in a direction transverse to the length of the joists or along the length of the joists and connected together by attachment of the connecting portion of one bridging support to the next bridging support. A support assembly of any desired length can be produced by adding further bridging supports to the last bridging support of the assembly so as to span any number of joists and provide a platform for laying flooring to span between adjacent rows of bridging supports. The bridging supports may all be the same. Alternatively, the bridging supports may include an end support for mounting at one end of a row and main supports for connecting a first said main support to the end support and thereafter connecting a second main support to the first main support and so on until the desired length of support assembly is produced.

BRIEF DESCRIPTION OF THE DRAWINGS

Preferred embodiments of the present invention will now be further described, by way of example only, with reference to the accompanying drawings, in which:

FIGS. 22 to 26 show a further embodiment of the system where a bridging support is formed of a main upstanding support leg with integral spanning element that leans on/couples to another upstanding leg, the main support leg being a composite with FIG. 22 showing an exploded assembly of the main support leg, FIG. 23 showing the assembled composite support leg, FIGS. 24A-B showing details of the composite support leg, FIG. 25 showing the inter-fit of the integral spanning portion of one support leg with another support leg and FIG. 26 showing the embodiment installed to joists/ceiling ties;

DESCRIPTION OF THE PREFERRED EMBODIMENTS

Figure 1:
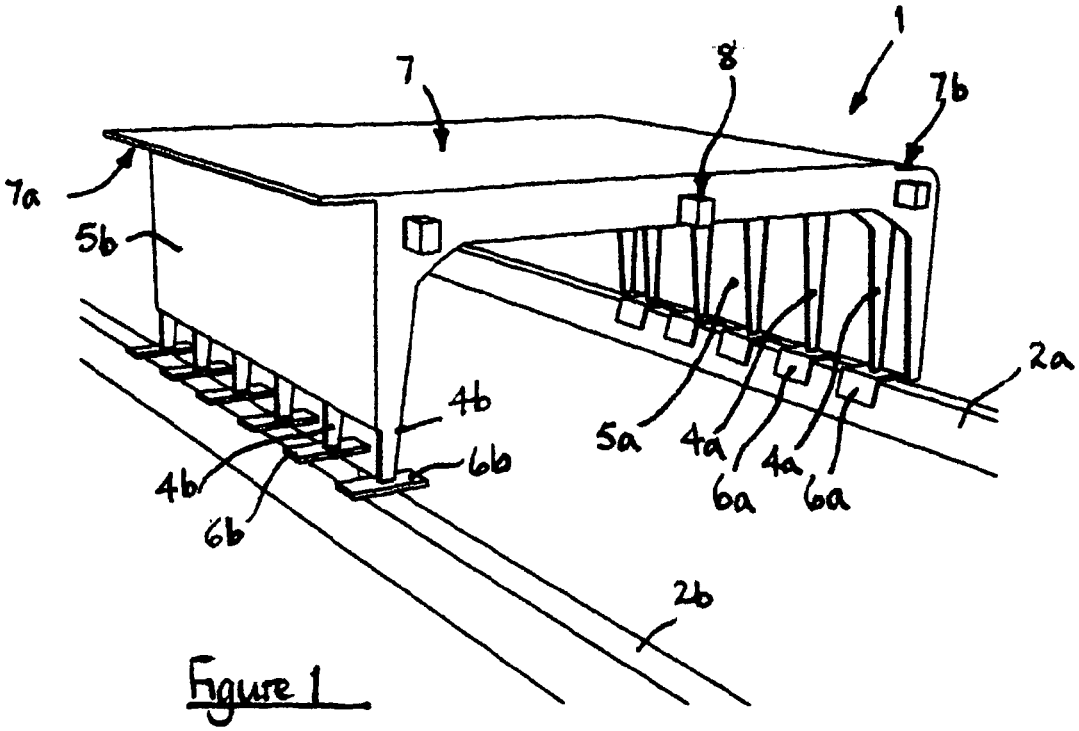
FIG. 1 is a perspective view of the first preferred embodiment of the bridging support of the system from a first end shown in situ mounted spanning a pair of loft floor joists.
Figure 2:
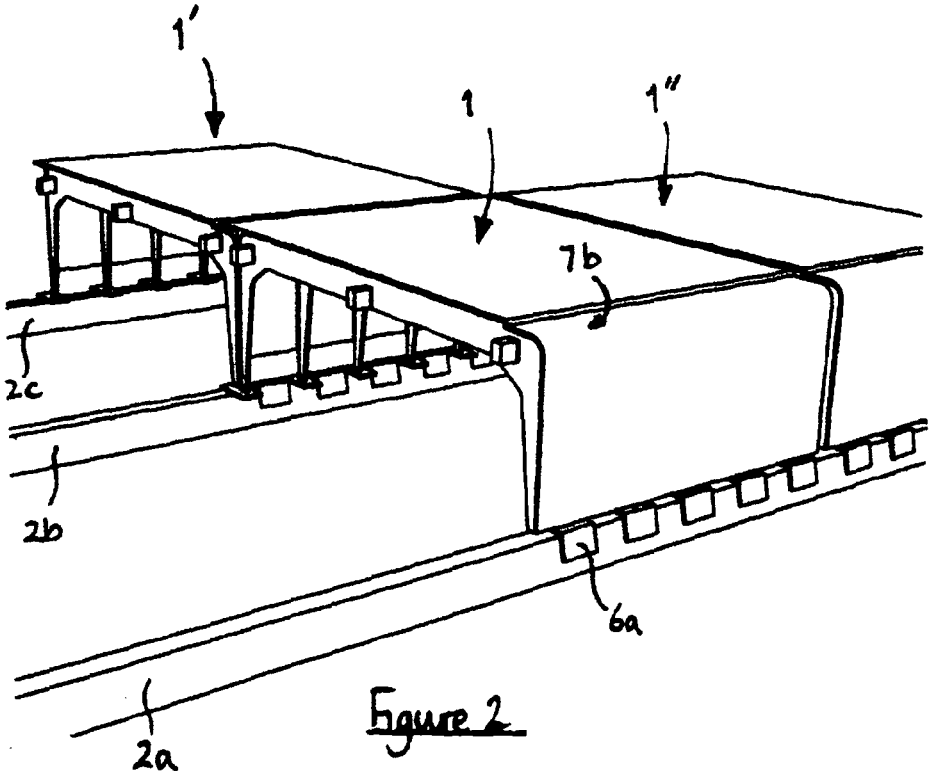
FIG. 2 is a perspective view of the bridging support of FIG. 1 but from the second end and further showing the next, adjacent bridging support in the joist-aligned direction and also the next adjacent bridging support in the joist-orthogonal direction.

Referring firstly to FIGS. 1 and 2, the main component of the system is a bridging support 1 that is adapted to bridge between the joists 2*a*, 2*b* of an adjacent substantially parallel pair of joists of a loft floor.

In the first preferred embodiment this bridging support 1 is suitably a plastics moulding that may be of nylon, polypropylene, HDPE or other strong plastics, optionally reinforced with fiberglass or other reinforcing material and which suitably is rigid and robust enough to bear double the weight of a 70 kg individual standing upon it.

The bridging support 1 has the form of a flat-arched, flat-sided tunnel with a row of first upright legs 4*a* along a first side that are interlinked by web sections that define a first sidewall 5*a* to the tunnel form. A corresponding row of second upright legs 4*b* along the opposing side of the bridging support 1 are interlinked by web sections that define a second, opposing, sidewall 5*b* to the tunnel form. Each of the first upright legs 4*a* has a foot 6*a* to mount onto the first of the joists 2*a* and each of the second upright legs 4*b* has a foot 6*b* to mount onto the second of the joists 2*b*. The foot 6*a* of each of the first upright legs 4*a* is formed as a saddle or inverted channel shaped bracket structure that fits over the top surface and both sidewalls of the first joist 2*a* so that the fit of the foot 6*b* to that joist limits or substantially prevents movement of the bridging support 1 in the direction orthogonal to the joist 1*a*.

The foot 6*b* of each of the second upright legs 4*b* is designed to float in the direction orthogonal to the joist 1*a*. It is formed as a flat/level plate that sits atop the second joist 2*a* and is longer orthogonally of the second joist 2*b* than the 35 mm thickness of the joist 2*b* so that it here provides some 80-100 mm tolerance for deviation of the span between central axes of the adjacent parallel joists 2*a*, 2*b* from standard.

For most houses constructed in the UK from the 1960s onwards the roof structure incorporates trusses and in such trussed roofs the loft joists' central axes are normally 600 mm apart. The span of the bridging support for such lofts should conform to that and thus be approximately 600 mm too. For optimal strength and security the centres of the legs (or central axes of the walls formed by the legs if the legs define walls) are suitably substantially aligned with the central axes of the joists and thus in this example also of a 600 mm span. However; there is some freedom either side of this but suitably limited by the thickness of the joists so that the leg/wall will bear directly down onto the joist to which it is mounted. Since the joists are generally of the order of 35 to 50 mm thick the span of the bridging support might be up to 25 mm more or less at each end, i.e. between 550 to 650 mm span, but preferably is 600 mm.

For older properties or those that otherwise lack trusses the commonest spacing between the loft joists' central axes is 430 mm apart. The span of the bridging support for such lofts should conform to that and thus be approximately 430 mm too. For each other different spacing between the loft joists' central axes a respective tailored bridging support span may be provided.

Spanning between the opposing sidewalls 5*a*, 5*b* of the tunnel-form of the bridging support 1 is the planar spanning element 7 that provides the platform on which the flooring chipboard or fibre-board flooring boards, planks or panels may subsequently be laid. The span of the planar spanning element 7 is adapted to conform to the separation of the joists 2*a*, 2*b* and forms the bridge/tunnel over the joists 2*a*, 2*b*. The channel or tunnel void 8 between the sidewalls 5*a*, 5*b* is notably aligned with and contiguous with the void/channel between the joists 2*a*, 2*b*. As a result of this configuration the insulation material may first be laid between the joists to the required depth rising above the joists and the bridging support then mounted in place accommodating the laid insulation without compacting the insulation. There is no need for back-filling or cross-laying the upper layers of insulation and no compaction. Furthermore, the system can be laid with much less reliance on nailing any components in place since the first foot 6*a* substantially restricts or prevents movement of the bridging support 1 in the direction orthogonal to the joist 1*a* and it will not, if un-nailed, inadvertently fall of the joist 2*a*. This in itself can make the system much quicker to install than prior art systems, and also quicker to lift up or uninstall when needed.

The spanning element 7 of each bridging support 1 is augmented by an extension section 7*a* that extends beyond the span 7 and which is adapted to provide an overlap with a next adjacent bridging support 1' on a next adjacent pair of joists 2*b*, 2*c* (see FIG. 2) to rest thereon. For optimal inter-fit this suitably is adapted to overlap a recess/rebate 7*b* provided on the near side of the next adjacent bridging support 1' so that the upper surfaces of the spanning elements 7 of each bridging support 1, 1' define a substantially continuous level support surface for the flooring.

Each bridging support 1, 1' is also suitably adapted to be able to inter-fit with each next adjacent bridging support 1" in the longitudinal direction of the joists suitably by having one or more protrusions/lugs 8 at one end thereof to locate in one or more sockets in the adjacent face of the next adjacent bridging support 1" in the longitudinal direction of the joists 2*a*, 2*b*.

The protrusions/lugs 8 are the thickness of a chipboard or fibre-board flooring panel lower, e.g. 18 mm lower, than the top surface of the spanning element 7. Such protrusions 8 can be provided at both ends of the bridging support 1, 1', 1" and can serve as a ledge/support shoulder for supporting an intervening flooring panel between adjacent bridging supports 1, 1" in the longitudinal direction of the joists 2*a*, 2*b* or can support an intervening floor panel between the last bridging support 1, 1" and the perimeter of the loft. This can reduce the number of bridging supports 1, 1', 1" needed to complete the desired loft flooring area and also gives flexibility in layout which can compensate for irregular coverage areas. For example, a fill-in terminal flooring panel section can be cut to span a gap at the end of an inter-joist channel after the last of a row of bridging supports 1, 1" since it would be impractical to make an end bridging supports 1, 1" in all possible lengths—other than by having a variably adjustable end extension.

Figure 4:
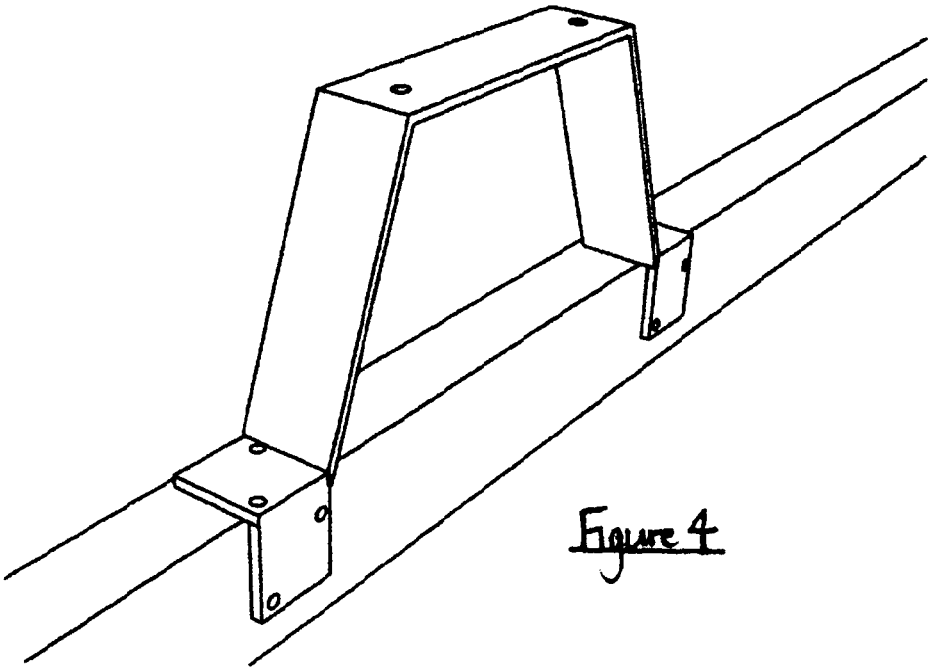
FIG. 4 is a perspective view of a perimeter support of the system for use lofts to support the flooring at the outer perimeter of the loft floor.

Preferably the bridging supports 1, 1', 1" are moulded to standard lengths of the order of 600 mm, 1200 mm and 1800 mm. If this length is greater than approximately 600 mm an intermediate support will be required. Where a fill-in terminal flooring panel section is used a small support bracket may be provided as illustrated in FIG. 4. This provides a support surface set at a slightly lower level (e.g. 18 mm below the level of the bridging supports 1, 1', 1") to line up with the level of the lugs/projections 8 of the bridging supports 1, 1', 1" so that the terminal flooring panel section is supported at the end of the inter-joist channel at the same level as the rest of the flooring.

The height of the bridging support 1, 1', 1" is selected to match the required extra height of the floor above the joists 2*a-c* to allow the required depth of insulation to be un-compacted. Thus for the case where the joists are 80 mm deep and the required depth of insulation is 250 mm the height of the bridging support is the extra 170 mm or so. For this and other embodiments the required insulation depth is likely to be between 250 mm and 400 mm and thus the height of the bridging support above the joists would only rarely need to exceed 350 mm.

The loft insulation material used may be of any suitable type whether currently known and commonplace or yet to be brought to market including, for example, glass fibre, foil-backed felt, rock fibre or mineral fibre blanket insulation—all of which are available in roll-form. These rolls fit snugly between the joists and are the most common type of insulation, being generally sold in 75 mm and 100 mm thicknesses and 300 mm to 1200 mm width, with lengths that range from 5 m to 9.4 m. Loose materials such as cork granules, exfoliated vermiculite, mineral wool or cellulose fibre are other available forms that could be used but are potentially very untidy and much less desirable. The most suitable form of insulation is roll-form and dimensioned to fit snugly between the joists up to the required 250 mm or 300 mm depth.

Figure 3:
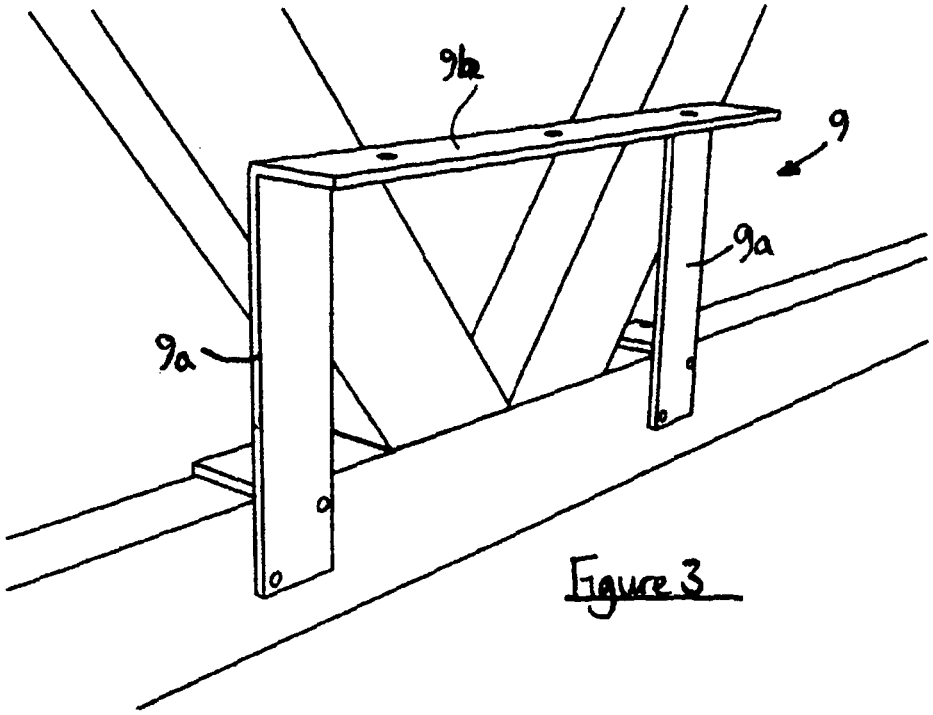
FIG. 3 is a perspective view of a perimeter support of the system for use in trussed-roof type lofts to support the flooring at the trusses.

For trussed roof lofts the system suitably includes additional components to fit at the trusses. Referring to FIG. 3 this shows a perimeter supporting device 9 that is shorter and slimmer than the bridging supports and suitably is of metal. It is provided to fit between the trusses where the truss diagonal members attach to the horizontal joist member of the truss. This perimeter supporting device 9 has a pair of legs 9*a* supporting a ledge/shelf-form element 9*a* that runs lengthwise of the joists projecting a few tens of mm from the joist but which does not span the joists. It sits on the horizontal element of the truss and serves to support the extension section 7*a* of the adjacent bridging support 1 that buts up close to the truss.

A further component that may be provided as part of the system to accommodate the problem of irregular widths between joists/trusses that exceed the design tolerance of 100 mm approx, is a simple bracket type component the same as or similar to that of FIG. 4, suitably made of metal and with holes so that it may be screwed to a board or a plank of timber (at the correct thickness). The board or plank can be sawn to the correct width and it will form the support for a chipboard or fibreboard flooring panel (that can also be cut to fit).

Figure 5:
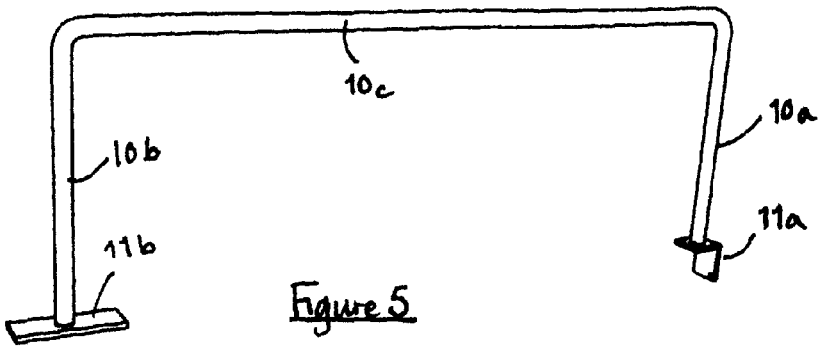
FIG. 5 is a perspective view of a bridging support of the system that functions in the same role as the bridging support of the FIG. 1 embodiment but is more basic in form, having a pair of pole-like legs and pole-like spanning element.
Figure 6A:
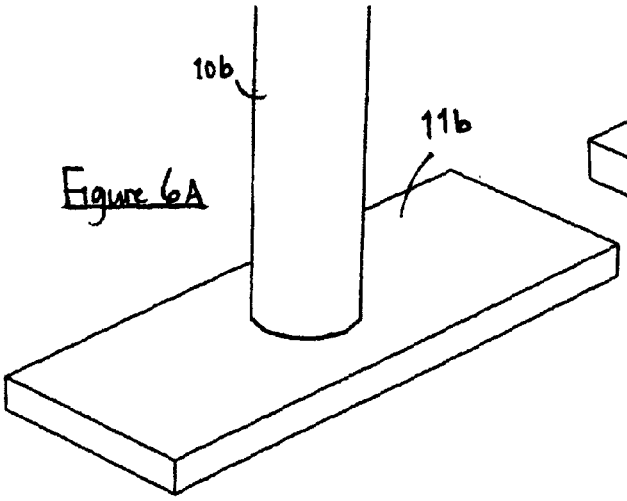
FIGS. 6A and 6B are each a perspective view of a respective one of the feet of the bridging support of the FIG. 5 embodiment.
Figure 6B:
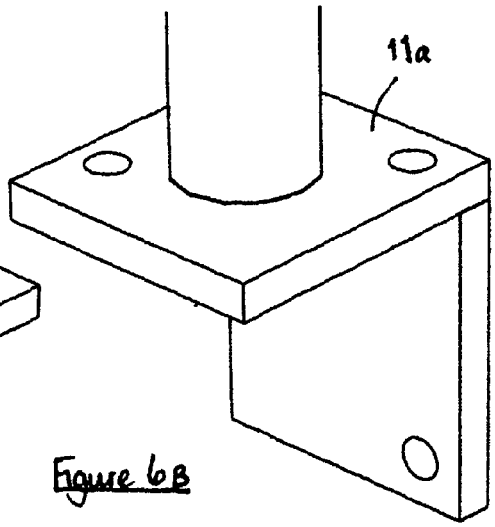

Turning now to FIGS. 5, 6A and 6B, these show a simplified bridging support 10, that functions in the same role as the bridging support 1 of the FIG. 1 embodiment but is more basic in form. This simplified bridging support 10 has a pair of pole-like legs 10*a*, one to mount on each of the adjacent joists 2*a*, 2*b*, and with pole-like spanning element 10*c* between them. Here the foot 11*a* of one leg 10*a* is a right-angled bracket while the foot 11*b* of the other leg 10*b* is a flat plate. The foot 11*a* of the first leg 10*a* that is a right-angled bracket may be nailed down if needed/desired.

Figure 7:
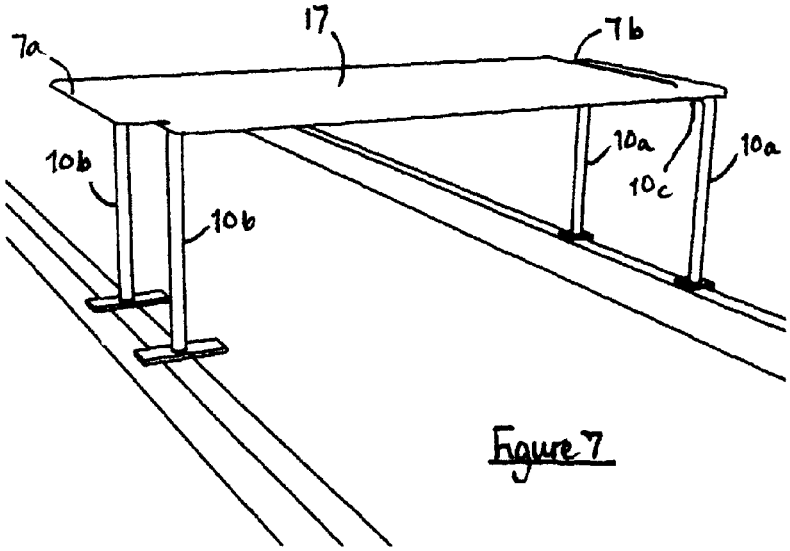
FIG. 7 is a perspective view of a further embodiment of the bridging support which again functions in the same role as the bridging support of the FIG. 1 embodiment.

FIG. 7 is a perspective view of a further embodiment of the bridging support which again functions in the same role as the bridging support of the FIG. 1 embodiment but is intermediate in form between that and the embodiment of FIG. 5. Here the bridging support is an assembly that incorporates a pair of simplified bridging support devices 10 overlaid with a moulded plastics panel element 17 similar to the spanning element 7 of the first preferred embodiment and with the same recess 7*b* and extension section 7*a* arrangement.

In a further embodiment of the bridging support 1, 10 the span of the support may be adjustable to accommodate further for different spans between joists. This may be achieved by making the span element 7, 17 and/or pole-like spanning element 10*c* or an extension of these, such as extension 7*a*, extend or retract in the spanning direction telescopically or by a scissor-like or concertina-extending construction or by other sliding, hinging or otherwise articulating arrangement, for example.

A yet further embodiment of the bridging support 1, 10 may be provided for use primarily where substantially rigid foam insulation is used instead of the more common compressible insulation materials such as mineral wool quilt. Here the chip board or fibre-board flooring panels will generally lay on the rigid foam but a support device may be provided to transfer some load onto the joists. To achieve this an adaptation of the previously described metal bracket/support could be used, comprising a right angle or saddle at the bottom to fix to the joist and a leg, e.g. 100 mm vertical wall section, with a supporting plate on top of the leg to support the floor board.

Figure 8:
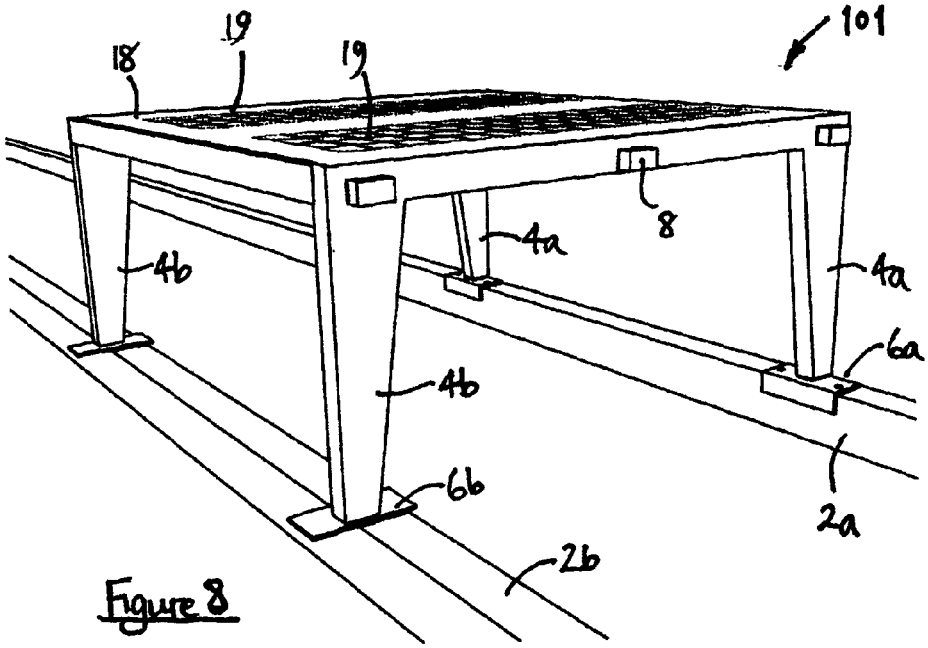
FIG. 8 is a perspective view of an embodiment of the bridging support, which has open sides.
Figure 10:
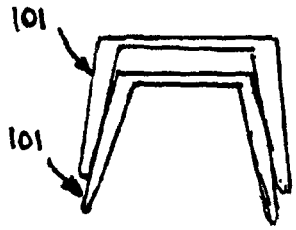
FIG. 10 is a schematic end elevation view of two modified bridging supports stacked one on top of the other.

Turning now to FIG. 8, this shows an embodiment of the invention in which the bridging support 101 is similar to that of the first embodiment in shape but like the embodiment of FIG. 7 is provided with only four legs 4*a*, 4*b* and no walls 5*a*, 5*b*, with one at each corner so that the form is that of an open-sided tunnel. This reduces the cost of the component and also facilitates accommodation of cross-laid insulation material. Thus, for example, where a first 150 mm of insulation is laid longitudinally along the inter-joist channel and then a further 150 mm laid orthogonally to that in order to overlap the joists, the bridging support 101 can straddle both directions of laid insulation material. For enhanced rigidity the structure may be formed of steel in the manner of a steel tube and could have a detachable upper plate or plastics moulding corresponding to the top surface of the FIG. 1 embodiment to provide the overlap extension section 7*a* and corresponding rebate 7*b*. The basic bridging support 101 may even be stream-lined enough and tapered so that it can stack in a similar manner to stackable crates and chairs (see FIG. 10).

In a further refinement illustrated in FIG. 8, the bridging support 101 has one or more mesh/gauze panels 19 provided in the spanning element 18 thereof and these mesh/gauze panels 19 provide a convenient means of anchoring screws or other fixings for attaching the chipboard or fibreboard flooring panels. This can make securing of the flooring panels to the bridging supports easier and may be employed in any embodiments.

Figure 9:
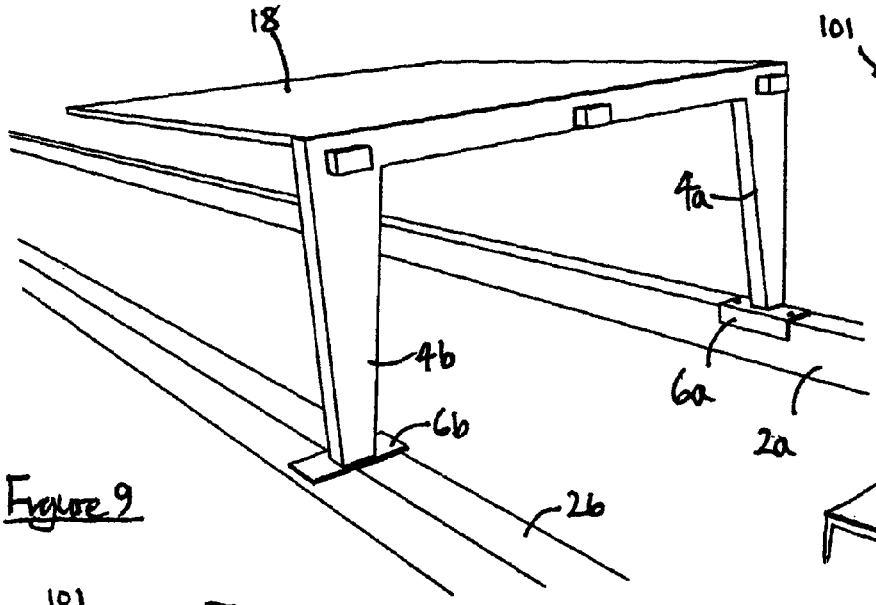
FIG. 9 is a perspective view of an embodiment of the bridging support, which has an unstable construction and designed to lean on a next adjacent bridging support.
Figure 11A:
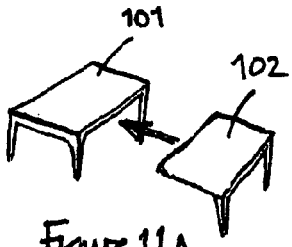
FIGS. 11A and 11B are, respectively, a perspective view of the FIG. 9 unstable two-legged bridging support being brought to lean on a next adjacent bridging support, and a perspective view of the inter-linking ends of the bridging supports of FIG. 11A.
Figure 11B:
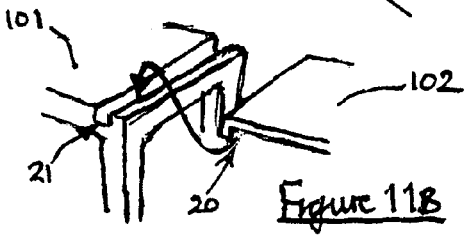

The system may suitably also be made modular in nature, using unstable/asymmetric/two-legged variants of the bridging supports that are able to lean on each other for support in the longitudinal direction of the joists/inter-joist channel and suitably ultimately propped up at an end of the channel by the at least four-legged bridging support 1, 10, 101 or other stable support. Such a two-legged variant of the bridging support 102 is shown in FIG. 9. FIGS. 11A and 11B show how the four-legged bridging support 1, 10, 101 and the two-legged bridging support 102 assemble together. As shown in FIG. 11B the two-legged bridging support 102 may latch/engage on the four-legged bridging support 1, 10, 101 (or a two-legged bridging support 102). The latching may, for example, be by inter-fit of a down-turned lip 20 on the leading edge of the two-legged bridging support 102 engaging in/releasably locking in a corresponding groove/socket 21 in the top at the adjacent end of the four-legged bridging support 1, 10, 101 as illustrated. Alternatively or additionally, where the end lugs/protrusions 8 are provided theses may provide the engaging/releasable locking features.

Figure 12:
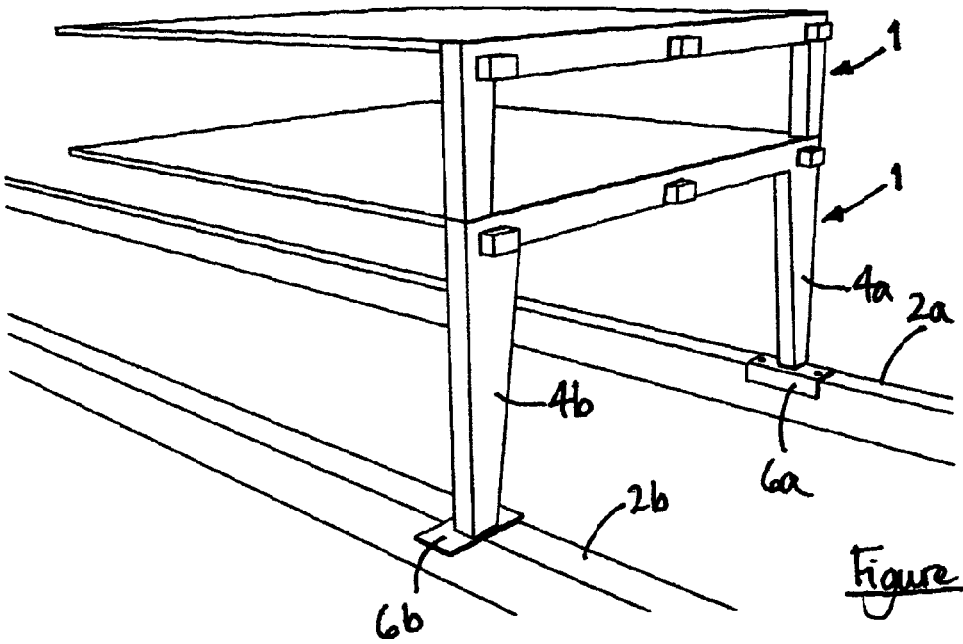
FIG. 12 is a perspective view similar to FIG. 9 and illustrating stacking of the bridging supports.

Referring now to FIG. 12, this shows the usage of the bridging support 1 of the present invention in a stacked multi-tier fashion to raise the height of the flooring even higher if desired. The feet 6*a*, 6*b* of the bridging support 1 may be modified/simplified to facilitate such stacking. Stackability may be made a feature of any of the various bridging supports/legs of the invention.

Figure 13:
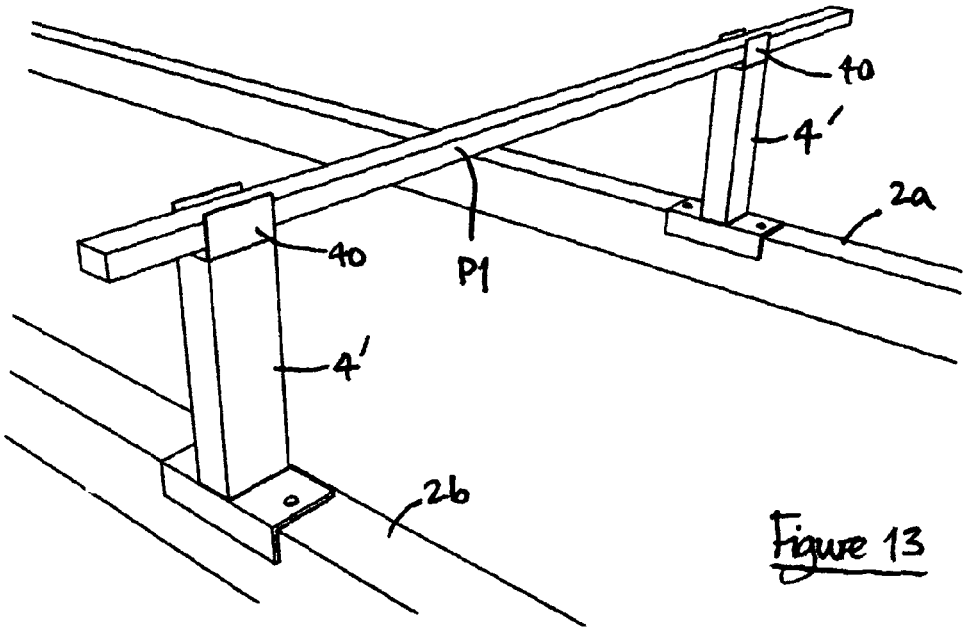
FIG. 13 is a perspective view of a variant of the flooring support system that is based on a set of individual legs that when paired up and used with spanning members function as bridging supports in use.

Turning to FIG. 13, this shows a flooring support system of the present invention that is based on a set of individual legs 4' that when paired up function as bridging supports in use. These individual legs 4' suitably each have a foot 6' in the form of a bracket, preferably a right-angled bracket or a saddle or inverted channel shaped bracket structure that fits over the top surface and one or both sidewalls of a joist 2*a* so that the fit of the foot 6' to that joist limits or substantially prevents movement in the direction orthogonal to the joist 1*a* and provides stability to the leg 4'. The legs 4' may be slim pillars or poles and in the illustrated embodiment each has a cradle 40 at its upper end to accommodate a beam or timber P1 to support the flooring panels, screwed, nailed or otherwise fixed to the beam or timber P1.

The cradles 40 may be replaced by a platform to support the flooring panels loosely or screwed, nailed or otherwise fixed thereto. The legs may be inter-linked in use by the flooring panels or, as illustrated in FIG. 13, by timber P1 or other operatively rigid leg spacing-maintaining linkages mounted extending between pairs of the legs 4'. In FIG. 13, timber P1 extends between adjacent pairs of the legs 4' spanning between joists 2*a* and 2*b* with one end of the timber P1 resting on the cradle 40 of one leg 4' and the other end resting on the cradle 40 of the adjacent leg 4' on the adjacent joist 2*b*. A further timber P2 (not shown) may extend from cradle 40 of first leg 4' lengthwise of joist 2*a* to a next adjacent leg 4'. Each timber end may abut a stop shoulder on a cradle 40 or leg 4 to maintain spacing between legs 4 or be screwed, nailed or otherwise fixed to cradle 40 or leg 4. The timbers P may be demounted or re-positioned as desired.

Figure 14:
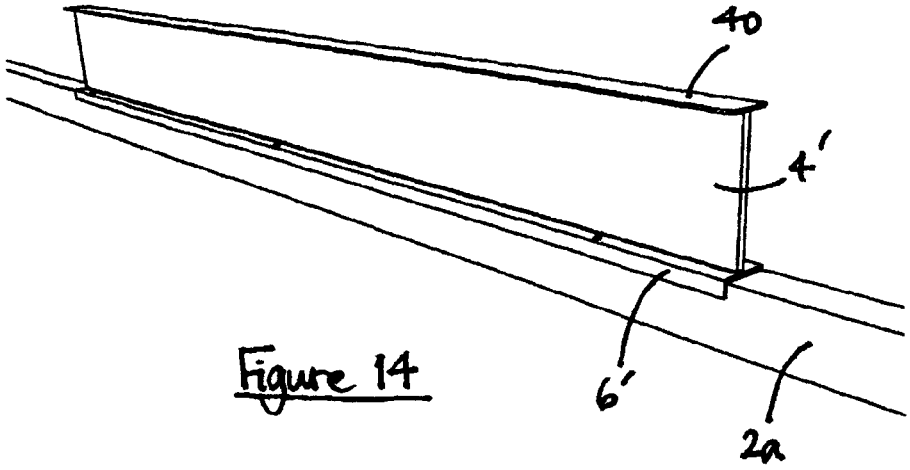
FIG. 14 is a perspective view of a variant of the individual leg arrangement of FIG. 13, in which each leg is in the form of an elongate beam running for a substantial distance lengthwise of the joist.

Turning now to FIG. 14, this shows a variant of the independent leg arrangement of FIG. 13, in which each leg 4' is in the form of an elongate beam, hereshown running for a substantial distance lengthwise of the joist 2*a*. With such a beam-form leg 4' there is less need for having a leg 4' to support all four corners of a flooring panel. One such beam leg 4' mounted on joist 2*a* and another on the adjacent joist 2*b* may in some cases suffice. This does, however, depend upon the length of the flooring panel lengthwise of the joists and the corresponding length of beam of the beam leg 4' as well as the strength of flooring panel and load to be supported.

Figure 15:
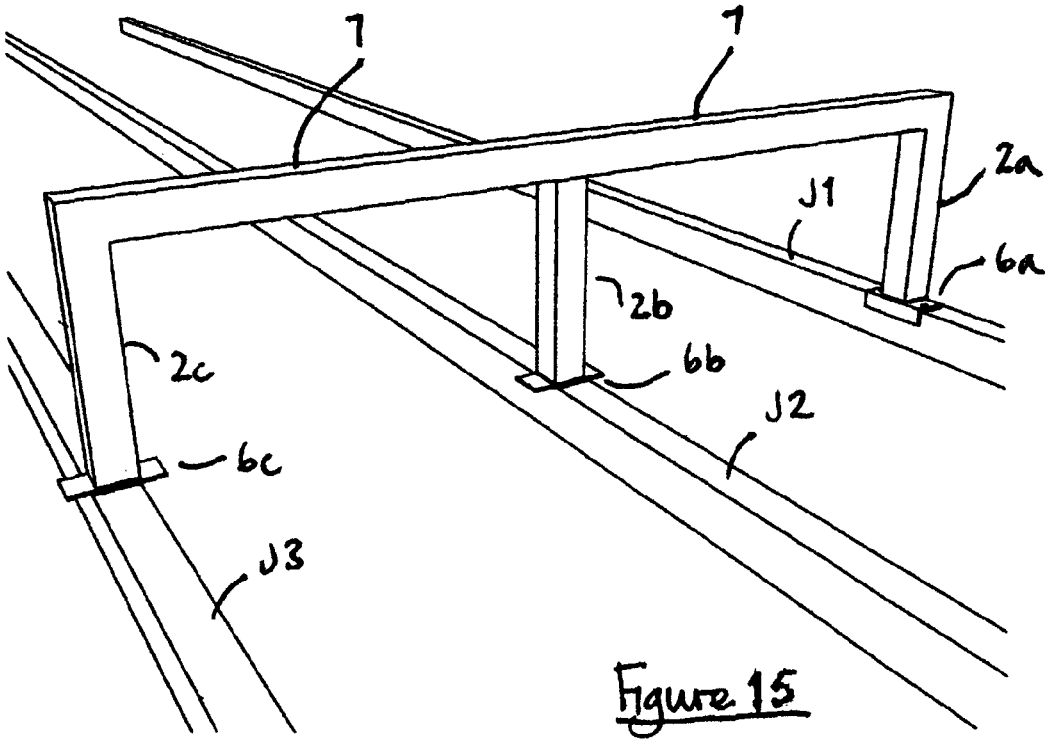
FIG. 15 is a perspective view of a variant of the bridging support having a third leg to which the planar spanning element further extends for spanning to a third adjacent joist.

In a further variant of the system as shown in FIG. 15, the bridging support 1 may comprise not simply two legs 4*a*, 4*b* and a planar spanning element 7 spanning between them and thereby spanning a pair of adjacent joists 2*a*, 2*b*, it may instead also comprise a third leg 4*c* to which the planar spanning element further extends for spanning to a third adjacent joist 2*c* (or fourth, fifth et cetera legs to cover multiple joist spans). The relative spacing of the legs 4*a*, 4*b*, 4*c* may be adjustable and in one variant of the bridging support at least one intermediate/second leg 4*b* may be demountable and/or repositionable. By way of example, if the bridging support (total spanning length) is 1200 mm long, to suit 600 mm spaced joists the intermediate/second leg 4*b* may be positioned at the middle of the 1200 mm whereas to suit 400 mm spaced joists the intermediate/second leg 4*b* may be repositioned ⅓ or ⅔ of the way along the length.

Figure 16A:
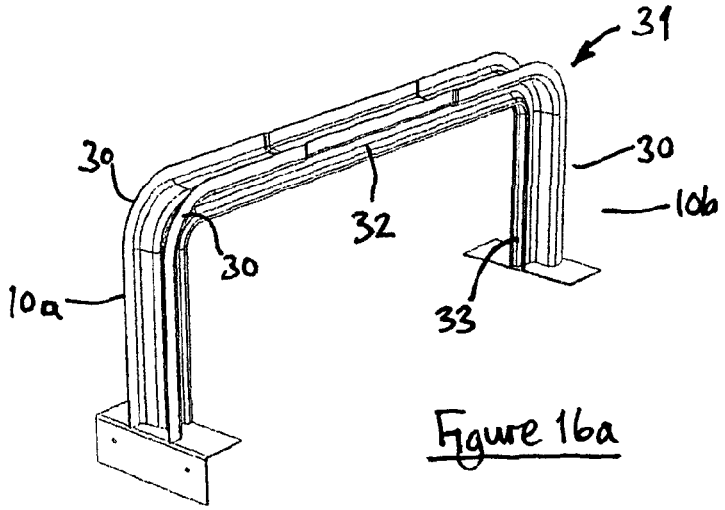
FIGS. 16A and 16B show an embodiment where the legs and spanning portion are all formed as complex profile ribbed mouldings.
Figure 16B:
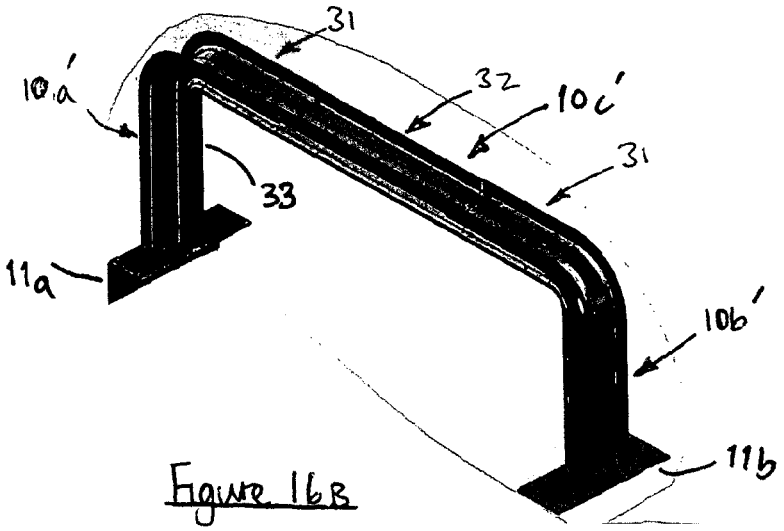

Referring to FIGS. 16A and 16B, these show an embodiment similar to that shown in FIGS. 5, 6A and 6B but where the legs 10*a*', 10*b*' and spanning portion 10*c*' are all formed as complex profile mouldings—suitably of pressed steel—having a profile with a pair of lateral ribs/flanges 30 running up the legs 10*a*', 10*b*' and along the spanning portion 10*c*' making them into U channel-shaped/channel-profiled members. These ribs/flanges 30 strengthen the bridging support 1. The spanning portion 10*c*' may be broadest between the flanges 30 at the end regions 31 proximate the legs 10*a*', 10*b*' and narrowed at its mid-span region 32. The mid-span region 32 may be a separate element arranged to telescopically collapse into the broader end regions 31. Alternatively it may be integrally formed or assembled with the end regions 31. In addition to the lateral ribs/flanges 30, the complex profile ribbed mouldings also have a medial axial rib/flange 33 that has a T-shaped profile and which strengthens the moulding from the underside. The legs 10*a* and 10*b* and spanning portion of the embodiment thus have the form of an I-beam.

Figure 17:
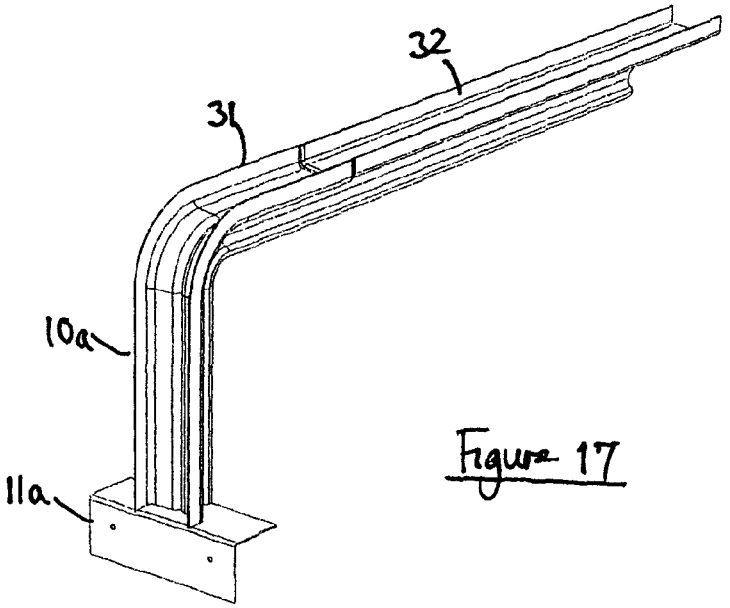
FIG. 17 is a perspective view of a further embodiment where the bridging support is formed of one upstanding leg and an integral spanning portion that is adapted to lean on a next adjacent bridging support in the directional orthogonal to the joists.

Referring to FIG. 17, this shows a further embodiment similar to that shown in FIGS. 16A and 16B but where the bridging support 1 is formed of one upstanding leg 10*a*" and a spanning portion 10*c*" that is adapted to lean on a next adjacent bridging support 1 in the directional orthogonal to the joists. This may be described in familiar terms as a 'piggy-back' configuration. In this embodiment the upstanding leg 10*a*" of the next adjacent bridging support 1 serves in place of a second upstanding leg 10*b*". The spanning portion 10*c*" terminates at its free end with an end of the narrow mid-span region 32 and which fits into the broad U-shaped channel 30*a* on the top of the end region 31 of the next adjacent bridging support 1. Here the underside strengthening axial rib/flange 33 that has a T-shaped profile terminates short of the free end of spanning portion 10*c*" so that the spanning portion 10*c*" may neatly overlap and inter-fit with the top of the end region 31 of the next adjacent bridging support 1.

Figure 18A:
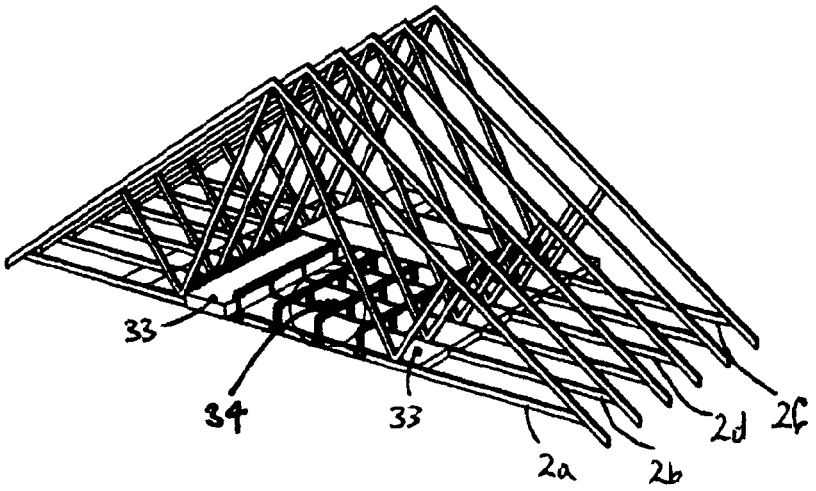
FIGS. 18A and 18B show the FIG. 17 system in an example installation in a typical trussed roof loft.

FIG. 18A shows the system of the present invention, comprising combinations of the FIGS. 16 and 17 embodiments, in an example installation in a typical trussed roof loft. The user has a choice of how the insulation 33 is laid and can run it all lengthwise of the joists 2*a-f* or, as shown, with the insulation 33 running in a first 100 mm layer lengthwise of the joists 2*a-f* between them and in a second 170 mm layer transverse/orthogonal to the joists 2*a-f* overlying the first layer.

Here the system has the unitary two-legged bridging supports 1 of the FIG. 16 type at regularly spaced intervals along the farthest right joist 2*f*. The co-operative leaning bridging supports 1 of FIG. 17 type are used at the other joists 2*a* to 2*e*. The bridging supports 1 extend orthogonal to the joists 2*a*-2*f* in parallel rows. Timber lengths 34 are mounted on the bridging supports 1 aligned with them, with one or a series of 50 mm wide by 25 mm thick timbers atop each row sitting in/on the U-shaped channel of the upper face of the bridging supports 1. These in turn provide a base onto which flooring panels of wood, chipboard or fibre-board may be laid.

In any of the embodiments of the invention provision may be made to reduce risk of cold bridging through the legs 4 to the joists by incorporating thermally insulating material into the design of the legs at manufacture or at installation.

Figure 18B:
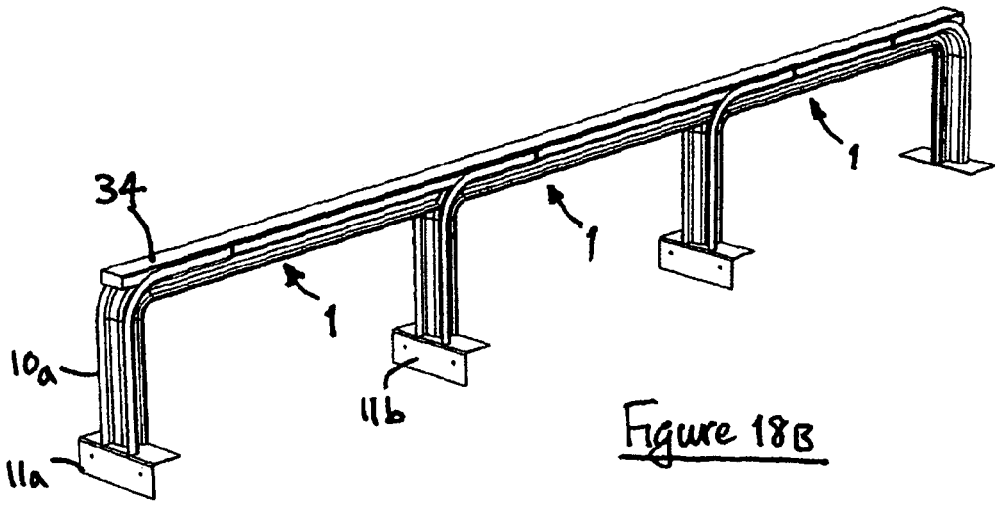
Figure 19:
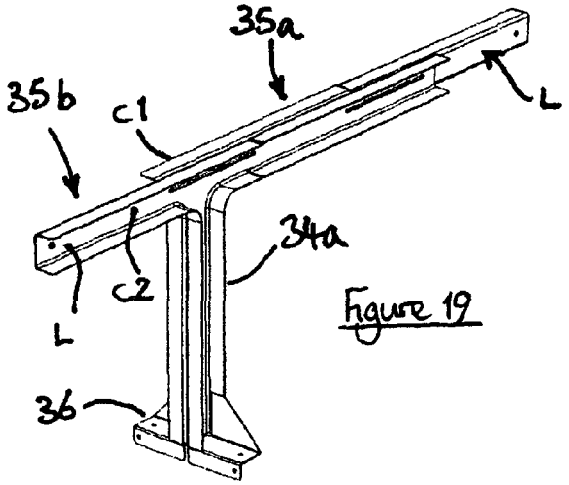
FIGS. 19 to 21 show a further embodiment of the system where the bridging support is formed of one upstanding leg with integral spanning portion that couples to another upstanding leg with integral spanning portion, with FIG. 19 showing a main support leg, FIG. 20 showing an end support leg (integral spanning portion for coupling extending only in one direction) and FIG. 21 showing the bridging supports assembled and installed to joists/ceiling ties.
Figure 20:
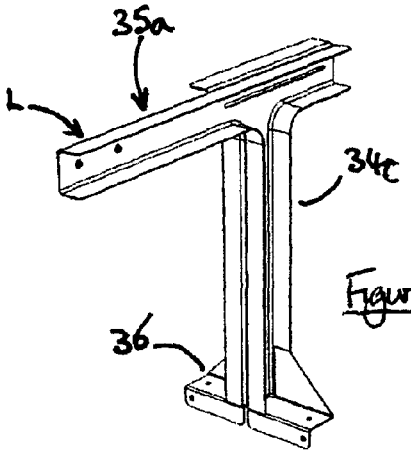
Figure 21:
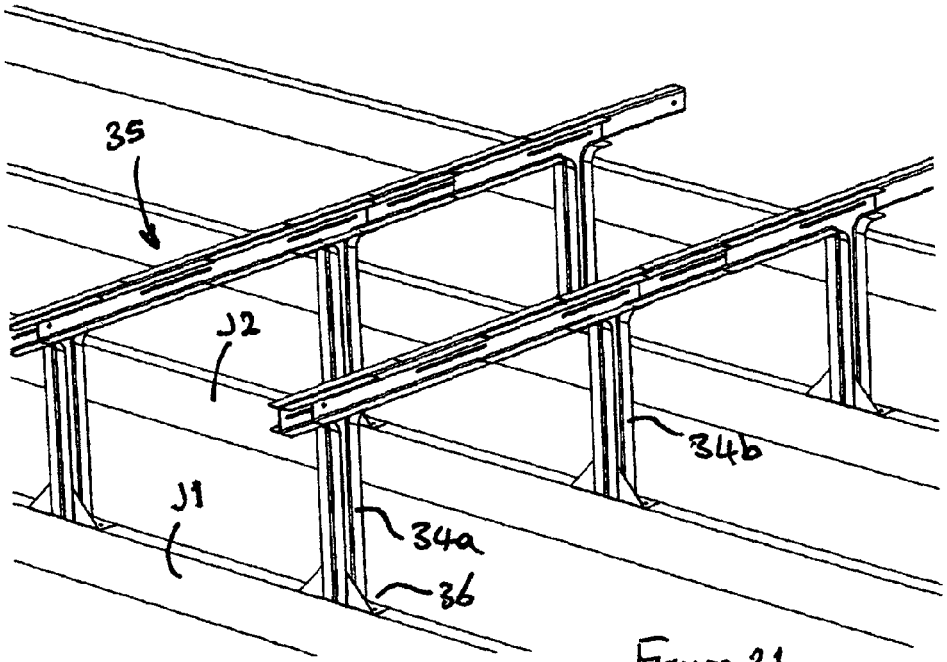

Referring now to FIGS. 19 to 21, these show a further embodiment of the invention wherein the bridging supports are modular and similar to that of FIGS. 17 and 18 in having a first leg 34*a* and integral spanning element 35*a* that mounts by a bracket foot 36 to one joist J1 and which is coupled in use to a second leg 34*b* that is mounted on a parallel joist J2. Here, however, each main support leg 34*a*, 34*b* bears a portion 35*a*, 35*b* of each overall spanning element 35 to span between the joists J1, J2 and these meet and are coupled together at a point between the joists. Each main support leg 34*a*, 34*b* has thus a T-shaped form with a first spanning element portion 35*a* projecting in one direction transverse of the joists and a second spanning element portion 35*b* projecting in the other direction. The bracket foot 36 of each main support leg 34*a*, 34*b* is suitably fastened to the corresponding joist J1, J2 by fixings such as self-tapping screws. Here the legs 34*a*, 34*b* and integral spanning element portions 35*a* are each suitably formed as pressed steel C-sections c1, c2 that are preferably spot-welded together back-to-back with their backs substantially in the vertical plane. The back-to-back C-sections c1, c2 of the spanning element portions 35*a*, 35*b* have an end region L where one C-section extends alone beyond the other C-section, creating the opportunity to overlap the extended C-section of one leg 34*a* with the extended C-section of the adjacent/second leg 34*b* whereby the first spanning element portion 35*a* of the first leg 34*a* may be fastened to the second spanning element portion 35*b* of the second leg 34*b*. Again, since the C-section is suitably of pressed steel the two may be fastened together by self-tapping screws.

Suitably the screws or other fixing/fastening means that secure the first spanning element portion 35*a* of the first leg 34*a* to the second spanning element portion 35*b* of the second leg 34*b* are accommodated by elongate slot-type bolt/screw holes or a series of bolt/screw holes through each spanning element portion 35*a*, 35*b* to allow selective adjustment of where along their lengths the spanning element portions 35*a*, 35*b* are secured together. This provides some adjustability in the extent of the overlap to accommodate any variations in joist spacing. The inter-locking of the spanning element portions 35*a*, 35*b* is such that the assembled bridging support retains good strength at any adjusted span.

In the example installation of FIG. 21 two rows of bridging supports are shown, each row having a first bridging support comprising two main support legs 34*a*, 34*b* joined together by a spanning element/connecting portion 35*a* and the second support leg 34*b* extending to form a second bridging support by being joined to a third leg—end support leg 34*c*. FIG. 20 shows the compact end support leg 34*c* that forms the end of a row and which, unlike the main support legs 34*a*, 34*b* has its integral spanning portion 35*a* extending only in one direction.

As with the installation of FIG. 18, in this embodiment the insulating material can be first laid between the joists preferably such as to rise to a level above the top of the joists and then further insulating material may be laid orthogonal/transverse to the joists between the bridging supports to cover the joists and to transversely cover the initially laid lengths of insulating material.

FIG. 21 shows the end supports of FIG. 20 mounted on the joist J1 and turned around so that the part 35*a* in FIG. 20 is extending towards joist J2. This part 35*a* corresponds to part 35*b* of the main support shown in FIG. 19 and the end support of FIG. 20 does not have a part corresponding to part 35*a* of the main support in FIG. 19. This allows the end support to be mounted on a joist that is close to a wall or other vertical surface where the part 35*a* of the joist in FIG. 19 would be too long to mount the main support. The end supports mounted on joist J1 are then attached to main supports mounted on joist J2 by overlapping the end portion L of the part 35*a* of the main support in FIG. 19 with the portion L of the part 35*a* (more correctly part 35*b*) of the end support in FIG. 20. The main supports on joist J2 then have part 35*b* extending towards the next joist (J3 not shown) which is the same as part 35*a* (more correctly part 35*b*) of the end support for attaching the next main support and so on until the required length of supports has been achieved. Part 35*b* of one support (either the end support or a main support) is attached to part 35*a* of the next main support where the parts L overlap.

When assembled the portion spanning the joists essentially has an I-section profile which is strong and which provides a flat upper surface on which to mount the flooring panels so as to spread the load. Supports may be mounted on each joist so that the spanning element between each pair of legs spans between adjacent joists as shown or on alternate joists (or with any other spacing) so that the spanning element spans across a joist(s) having no support. In an alternative arrangement (not shown), the bridging supports may be mounted so as to extend along the length of the joists so that insulation can be laid to the required depth between the joists rather than transverse to the joists as in FIG. 21. In some applications it may not be necessary to employ the end support of FIG. 20 at the end of a row and the bridging supports could be assembled using the main supports of FIG. 19 only).

Referring now to FIGS. 22 to 26, these show a further embodiment of the invention where each bridging support assembles in a 'piggy-back' configuration, with a main upstanding support leg 37*a* with integrally assembled spanning element 38 that leans on/couples to another upstanding leg 37*b*. The main support leg 37*a* is a composite structure that is both a composite of materials and of components. Leg 37*a* comprises an upstanding leg column 39 that is suitably moulded of plastics and which terminates at its lower end in a foot 40 comprising a right-angled (L-shape profile) bracket to be fixed to a joist J. The upper end of the leg column 39 has a pair of T-shaped sockets 41 to receive L-shaped profiles (L-sections) of the spanning element 38. The spanning element 38 assembles to the leg column 39 by slotting into the sockets 41 of the leg column 39 and preferably does so in a demountable/dis-assemblable manner. The spanning element 38 is suitably a composite of a steel skeleton 42 with a plastics moulded case or upper panel 43 that suitably clips, slides or otherwise fastens onto steel skeleton 42 to provide a medium into which fixings such as screws or nails may be driven to secure the overlying boards/panels of the flooring. Forming the spanning element 38 with a sturdy skeleton 42 manufactured from pressed steel (suitably in one piece) reduces cost to manufacture and because the steel is not the fixing medium it can be thicker and stronger than when the steel of the spanning element is the fixing medium.

The pressed steel skeleton 42 in the illustrated embodiment in FIG. 22 separates/forks into a pair of L-shaped profiles (L-sections) 42*a*, 42*b* that bend downwards to fit into the upwards facing T-shaped sockets 41 of the leg column 39. The upstanding leg column 39 since it has T-shaped sockets 41 for L-shaped profiles is effectively reversible to be used facing in either direction transverse of the joists J. This enables obstructions such as wiring that is fixed on one side of a joist J to be avoided. For example, if there are cables on one side of a joist the leg column 39 can be removed and reversed to avoid them. It will also make it much easier to stack the components, thereby reducing transport costs. The plastic leg column 39/foot 40 will also greatly reduce cold bridging (avoiding need for an insulating material attached to the contact points of the foot to be a thermal break). Where the bridging support leg's foot is not plastic but metal a thermal break (an insulating material) is preferably fixed to the bottom of the foot and side plate (the contact points with the joist) when installing the system, to reduce cold bridging.

Figure 25:
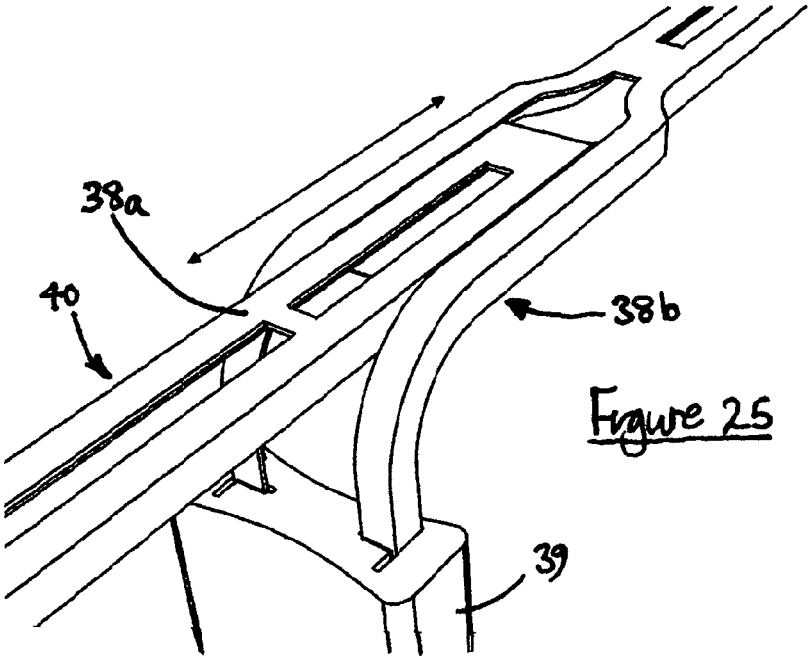

Referring to FIG. 25, the spanning element 38 is narrower at its distal end 38*a* compared to its proximal end 38*b* (end overlying the leg column 39) whereby the distal end 38*a* of the spanning element 38 of a first upstanding support leg 37*a* may slot into the proximal end 38*b* of a second upstanding support leg 37*b*. Here the distal end 38*a* fits in the fork of the pair of L-shaped profiles (L-sections) 42*a*, 42*b* and a shelf S (see FIG. 24) extending between the L-shaped profiles (L-sections) 42*a*, 42*b* supports the distal end 38*a* of the spanning element 38 whereby the spanning element 38 of the first upstanding support leg 37*a* piggy backs on the second 37*b*.

Figure 26:
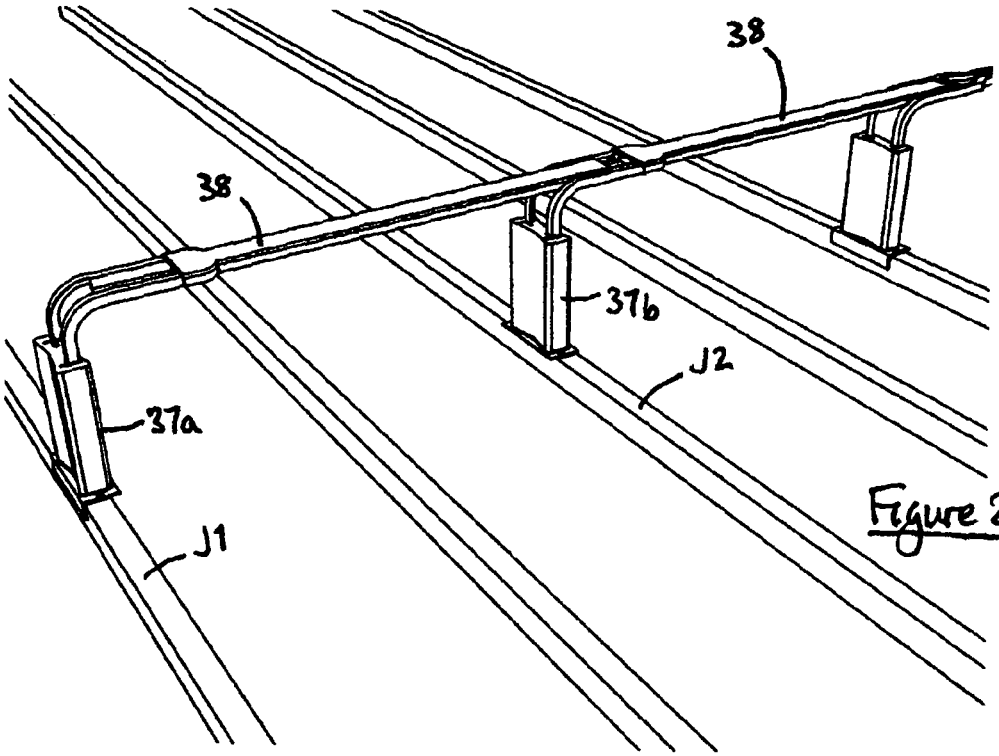

In the illustrated embodiment of FIG. 26, each bridging support spans two adjacent parallel joists (1200 mm span) and thereby each bridging support is able to avoid intervening obstructions. Where this is used as a primary/main component throughout the system it enables a substantially quicker and cheaper installation. The composite construction and other features of this bridging support can of course be applied to single spans (e.g. 600 mm and 430 mm inter-joist span) and for optimal stability each row of the installed system suitably at least starts with a single span bridging support.

Figure 27:
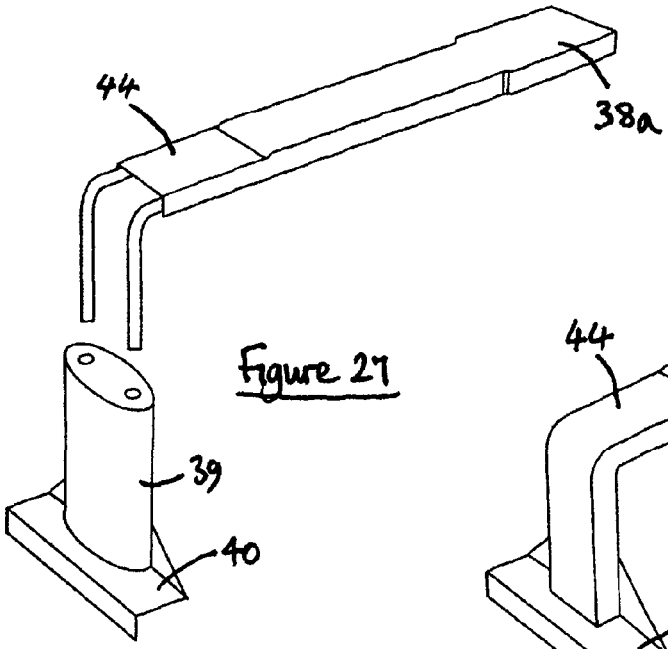
FIG. 27 shows a variant composite support leg.
Figure 28:
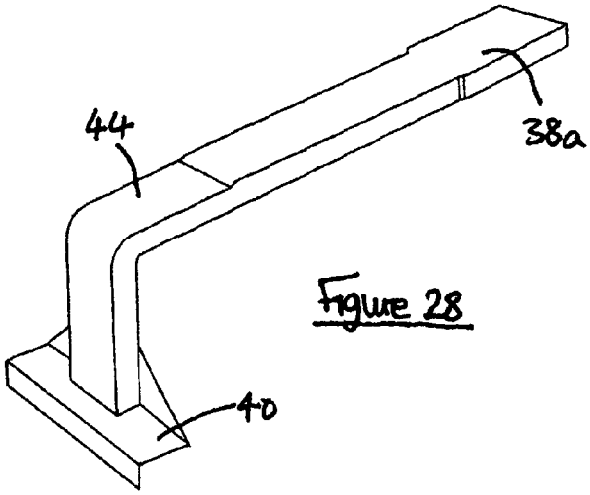
FIG. 28 shows a further variant support leg.

A further, less sophisticated version of 'piggy-back' configuration of bridging support is shown in FIG. 27. The main support leg with integral spanning element is again a composite assembly of a unitary plastic leg column 39/foot 49 to which a proximal end of a spanning element mounts. Here, however, the distal end 38*a* of the spanning element 38 is not narrowed to fit within a proximal end 38*b* of a second upstanding support leg 37*b*, but rather it seats on top of a down-stepped shoulder 44 of a second upstanding support leg 37*b*. FIG. 28 shows a version of this that has the leg unitary (e.g. integrally moulded) with the spanning element 38 rather than assembled to it.

Figure 29:
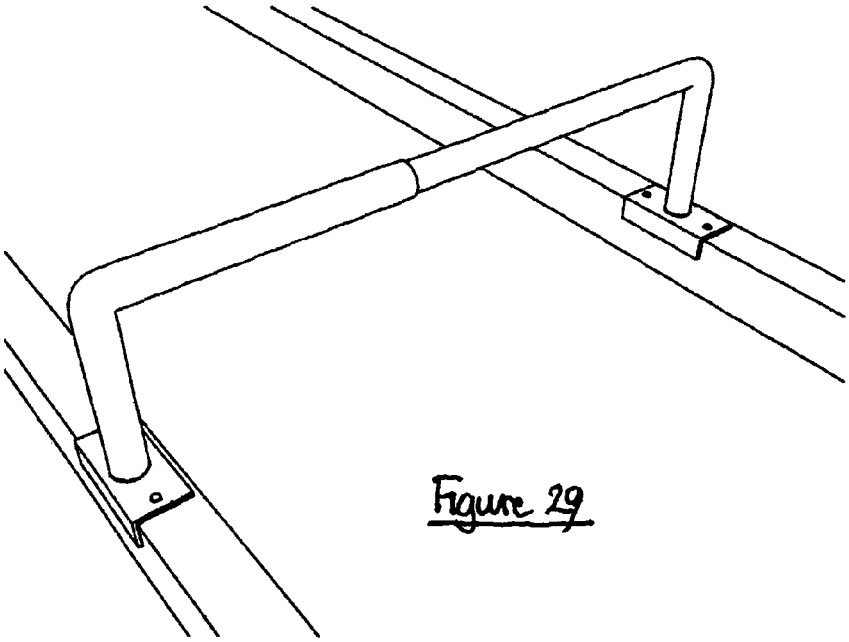
FIG. 29 show an embodiment of the system where the bridging support is formed of one upstanding support leg with integral spanning portion that couples to the integral spanning portion of another upstanding leg, where the coupling is telescopic allowing for adjustment of span.

Finally, referring to FIG. 29, this illustrates an example telescopic version of bridging support and although exemplified as being of tubular steel construction may be of any suitable form to allow adjustment of the span.

The invention is not limited to the embodiments above-described and features of any of the embodiments may be employed separately or in combination with features of the same or a different embodiment and all combinations of features to produce a loft flooring system are within the scope of the invention.

The invention claimed is:

1. A loft flooring system installed to the joists of a loft floor having a void/channel between a joist of the loft floor and loft insulation laid in the void/channel between the joists, the system comprising:

a plurality of bridging supports each bridging support bridging between a substantially parallel pair of joists of a loft floor and each having:

i) a first upright leg with a fool mounted onto a first of said pair of joists;

ii) a second upright leg with a foot mounted onto a second of said pair of joists; and iii) a spanning element that is a beam spanning between the upper ends of the legs, the bridging supports being assembled connected in a row to provide a support assembly extending in a direction transverse to the joists with a flooring board or panel laid thereon, wherein the bridging support forms a bridge over the joists at a height above the joists with a void between the legs that is contiguous with the void/channel between the joists so that the insulation laid between the joists is not compacted by the bridging support, and wherein the foot of the first and/or second upright leg is formed with a right-angled bracket that fits to a top surface and a sidewall of the joist.

2. A loft flooring system as claimed in claim 1, wherein one of the first and second legs has a foot in the form of such a bracket while the other of the first and second legs has a foot in the form of a plate.

3. A loft flooring system as claimed in claim 1, wherein the bracket is provided with a channel profile to fit not only to a top surface and a sidewall of a said joist but to the opposing sidewall too as a saddle whereby the fit of the bracket to that joist, limits or substantially prevents movement of the bridging support in the direction orthogonal to the joists.

4. A loft flooring system as claimed in claim 1, wherein the legs of the bridging supports are spaced apart by a span of 400 mm or 600 mm plus or minus up to half the thickness of the joists.

5. A loft flooring system as claimed in claim 1, wherein the system comprises a plurality of flooring panels of chipboard or fibre-board to overlie the bridging supports to define the loft flooring.

6. A loft flooring system as claimed in claim 1, wherein a said bridging support comprises at least three legs in use each mounted atop a respective one of a corresponding number of joists.

7. A loft flooring system as claimed in claim 1, wherein a said bridging support has one or more panels of mesh/gauze or of plastic provided in or as the spanning element thereof to anchor screws or other fixings for attaching the flooring panels thereto.

8. A loft flooring system as claimed in claim 1, wherein a said bridging support is an assembly that comprises a first leg to mount in use to a first joist and an initially separate second leg to mount in use to a second joist, the first leg having a spanning element or a portion of a spanning element thereon that is adapted at its distal end to lean on or be fixed to the second leg or fixed to a portion of a spanning element on the second leg.

9. A loft flooring system as claimed in claim 8, wherein the spanning element on the first leg is adapted to latch/engage on said second leg.

10. A loft flooring system as claimed in claim 8, wherein the spanning element on the first leg is adapted to seat onto a shoulder on an upper part of the second leg.

11. A loft flooring system as claimed in claim 8, wherein the first leg has an integral said spanning element or integral portion of a said spanning element.

12. A loft flooring system as claimed in claim 8, wherein the first leg has the spanning element fitted to it in use.

13. A loft flooring system as claimed in claim 12, wherein the spanning element is de-mountably fitted to the first leg.

14. A loft flooring system as claimed in claim 1, wherein a said bridging support has a ribbed or U-shaped profile, with a pair of lateral ribs/flanges defining a channel therebetween.

15. A loft flooring system as claimed in claim 14, wherein the channel is broader at the region over the legs than at a region remote from the legs.

16. A loft flooring system as claimed in claim 1, wherein the spanning element is telescopic/able to be lengthened and shortened in span.

17. A loft flooring system as claimed in claim 1, wherein the spanning element or a portion of the spanning element has a sturdy metal or metal alloy skeleton and a plastic panel or sheath fitted or moulded thereon for fixing thereto the overlying flooring panels.

18. A loft flooring system as claimed in claim 1, wherein the first leg has a column and the foot of the first leg is demountable from the column.

19. A loft flooring system as claimed in claim 1, wherein the foot of the first leg is partly or wholly of plastics whereby it counters cold-bridging.

* * * * *